US005254077A

United States Patent [19]

Nottingham et al.

[11] Patent Number: 5,254,077

[45] Date of Patent: Oct. 19, 1993

[54] TETHERED RING-SHAPED TOY

[75] Inventors: John R. Nottingham; John W. Spirk, Jr., both of Moreland Hills; Webster, Jr. Paul T., Chagrin Falls; Christopher S. Lynch, Lakewood, all of Ohio

[73] Assignee: Nottingham-Spirk Design Associates, Inc., Cleveland, Ohio

[21] Appl. No.: 825,031

[22] Filed: Jan. 24, 1992

[51] Int. Cl.[5] ..... A63H 27/00

[52] U.S. Cl. ..... 446/48; 446/46; 273/424

[58] Field of Search ..... 446/34, 46, 48; 273/424, 425

[56] References Cited

U.S. PATENT DOCUMENTS

| | | | |
|---|---|---|---|
| D. 209,763 | 1/1968 | Mueller . | |
| D. 326,121 | 5/1992 | Asner . | |
| 1,966,895 | 7/1934 | Kuhns . | |
| 3,359,678 | 11/1965 | Headrick . | |
| 3,580,580 | 5/1971 | Wark . | |
| 3,590,518 | 7/1971 | LeBaron | 273/425 X |
| 3,673,732 | 7/1972 | Liotta . | |
| 3,724,122 | 4/1973 | Gillespie, Sr. . | |
| 3,976,297 | 8/1976 | Seymour | 446/46 X |
| 4,045,029 | 8/1977 | Katzmark | 273/425 |
| 4,051,622 | 10/1977 | Sharp | 446/48 |
| 4,157,631 | 6/1979 | Kifferstein et al. . | |
| 4,421,320 | 12/1983 | Robson | 273/425 |
| 4,869,699 | 9/1989 | Plambeck et al. | 446/46 X |
| 5,080,624 | 1/1992 | Brinker | 446/48 |

*Primary Examiner*—Robert A. Hafer
*Assistant Examiner*—Sam Rimell
*Attorney, Agent, or Firm*—Calfee, Halter & Griswold

[57] ABSTRACT

A tethered flying toy includes a ring-like frame rotatable about an axis substantially perpendicular to the plane of the toy. The frame extends outwardly and upwardly from the plane of the toy away from the axis and has a downwardly extending skirt around the periphery thereof. The frame includes an inner circumferential edge defining an opening and the skirt includes an outer circumferential edge defining a border. The outer circumferential edge of the skirt extends in a plane parallel to but in upwardly offset relation from the plane of the inner circumferential edge. The frame also includes an S-shaped cross member interconnecting diametrically opposed portions of the frame. A tether line extends through an aperture formed in the cross member to a wrist strap which can be located around the arm of the thrower. An elastic band portion interconnects the wrist strap and the tether to provide elasticity for the tether during the flight of the toy. When the flying toy is not in use, the tether can be wrapped in a coil transversely around the frame in notches located substantially perpendicular to (i.e., 90° offset from) the cross member to prevent warpage or bending of the frame during storage.

17 Claims, 4 Drawing Sheets

TETHERED RING-SHAPED TOY

FIELD OF THE INVENTION

The present invention relates generally to flying toys, and more particularly to tethered, ring-shaped, flying toys.

BACKGROUND OF THE INVENTION

Saucer or disk-type flying toys are well known. For example, one known type of flying toy marketed under the brand name "Frisbee" has a disk of plastic material with a rim portion at its periphery and a central dome or flat portion molded integrally with the rim, as described in Headrick, U.S. Pat. No. 3,359,678, and Gillespie, Sr., U.S. Pat. No. 3,724,122. Another known type of flying toy marketed under the brandname "Aerobie" has a planar ring of plastic material. Normally, these types of toys are thrown generally horizontally with a spinning motion and have a drifting or somewhat floating flight path. The path of the flight is particularly affected by the manner in which the disk is oriented when thrown, and the direction of the prevailing wind or air currents. Although these types of disks can be thrown in a manner to cause them to curve substantially during flight, it is not always possible to have the disks return to the original location of the thrower.

However, flying disk-type toys have been developed which are tethered so that the toy returns to, and even passes by repeatedly, the thrower during flight. For example, Liotta, U.S. Pat. No. 3,673,732, discloses an aerial toy having a ring-like body and an elastic tether connected to the upper surface of the body at a point generally on the central axis and somewhat at or below the general plane of rotation of the toy. The free end of the tether is held in one hand, and the toy is thrown in the standard manner wherein the wrist is snapped to impart spin to the body of the toy. The toy is launched in a generally horizontal direction and travels the length of the elastic tether until the tether becomes taught. The disk is then returned under the influence of the tether in a direction generally toward the thrower. If sufficient spin is imparted to the body of the toy, the toy can make several passes away from and back to the thrower while maintaining a generally stable, horizontal flight.

A similar type of flying toy is shown in Seymour, U.S. Pat. No. 3,976,297, which discloses a disk-shaped toy which is rotatably attached to one end of a monofilament or nylon string. The Seymour toy differs from the Liotta toy in that a loop of string extends through a center sleeve in the axis of the to, which is then connected by a swivel to a main string length to prevent twisting when winding or unwinding the main string length.

Although the above-described flying toys provide a certain amount of entertainment and amusement, they are not without drawbacks. For example, the disk-shaped toy of Seymour is relatively heavy as compared to the ring-shaped toy of Liotta, and can therefore have a relatively shorter flight path. On the other hand, even though the Liotta flying toy has a ring-like shape, the elastic tether on the Liotta toy can add weight to the toy during flight and can thereby also shorten or even destabilize the flight path.

Additionally, there can be issues associated with storing these types of flying toys such that the tether does not become tangled or knotted, or that the toy does not become warped or bent from heat, sunlight, etc. A warped disk-type or ring-type toy can become destabilized during flight and therefore have a shorter flight path.

Accordingly, there is a constant demand in the industry for improved flying toys, and more particularly, for improved tethered, ring-shaped, flying toys which have aerodynamic qualities for long flights, have designs which allow the thrower to become proficient with the toy in a brief period of time, and which can be stored so as to prevent warpage or bending of the toy.

SUMMARY OF THE INVENTION

The present invention provides an improved flying toy, and more particularly provides an improved tethered, ring-shaped flying toy. The flying toy has aerodynamic qualities which provide long flights, has a design which allows the thrower to become proficient with the toy in a brief period of time, and can be stored so as to prevent warpage or bending of the toy when not in use.

The flying toy of the present invention has a lightweight outer ring-like frame which is formed e.g., molded, in one piece. The toy is rotatable about a central axis which extends substantially perpendicular to the plane of the toy. The frame is angled upwardly and outwardly from the plane of the toy and has a downwardly extending skirt around the periphery thereof. The inner and outer circumferential edges of the frame can also have strengthening ribs or beads to provide rigidity and stability for the toy during flight. The outer circumferential edge of the skirt lies in a plane which extends in parallel, but upwardly offset relation from the plane of the inner circumferential edge of the frame to enhance the lift of the toy.

An S-shaped cross member is formed e.g., molded, in one piece with the ring-like frame and interconnects diametrically opposed portions of the frame. The cross member preferably extends across the plane of the toy in flat and level relation thereto to provide lift and stability during flight. The cross member can also have strengthening ribs or beads along opposite edges to provide rigidity for the otherwise thin piece.

A tether extends through an aperture formed in the cross member at the central axis of the toy. A portion of the tether forms a loop around the ring-like frame. The loop is connected by a swivel to a main portion of the tether, which in turn has its free end connected to a wrist strap which wraps around the thrower's arm.

The wrist strap includes a relatively short elastic band portion which interconnects the strap with the main portion of the tether. The elastic band portion provides a certain amount of elasticity during the flight of the aerial toy, and in particular when the toy reaches the end of the tether. However, the elastic band portion is short enough to have a negligible effect on the weight of the toy, and hence the distance of flight. Moreover, the band portion is spaced distant from the toy so as not to interfere with the path of flight of the toy.

When the toy is not in use, the tether can be wrapped in a coil transversely across the outer frame to prevent tangling or knotting of the tether. The tether is preferably wrapped around notches formed in the outer circumferential edge of the frame. The notches are offset 90° from the cross member so that when the tether is wrapped around the frame, the compression and tension forces on the frame prevent the frame, and in particular the cross member, from warping or bending during storage. The notches are also tapered to prevent the loop of the tether from catching during rotation of the toy in flight and to reduce chafing or rubbing of the tether.

It is therefore one object of the present invention to provide an improved ring-shaped flying toy which has a cross-sectional profile which provides lift and stability, and hence has certain aerodynamic qualities for long flights.

It is another object of the present invention to provide an improved tethered flying toy having an elastic band portion which provides a certain amount of elasticity for the tether during flight, and yet does not effect the weight and stability, and hence the flight distance, of the toy.

It is still another object of the present invention to provide an improved ring-shaped flying toy having a tether which can be wrapped in a coil around the toy in such a manner that warpage or bending of the toy is prevented during storage.

Further objects of the present invention will become more apparent from the following detailed description and the accompanying drawings.

DETAILED DESCRIPTION OF THE DRAWINGS

DETAILED DESCRIPTION OF THE PREFERRED EMBODIMENT

Figure 1:
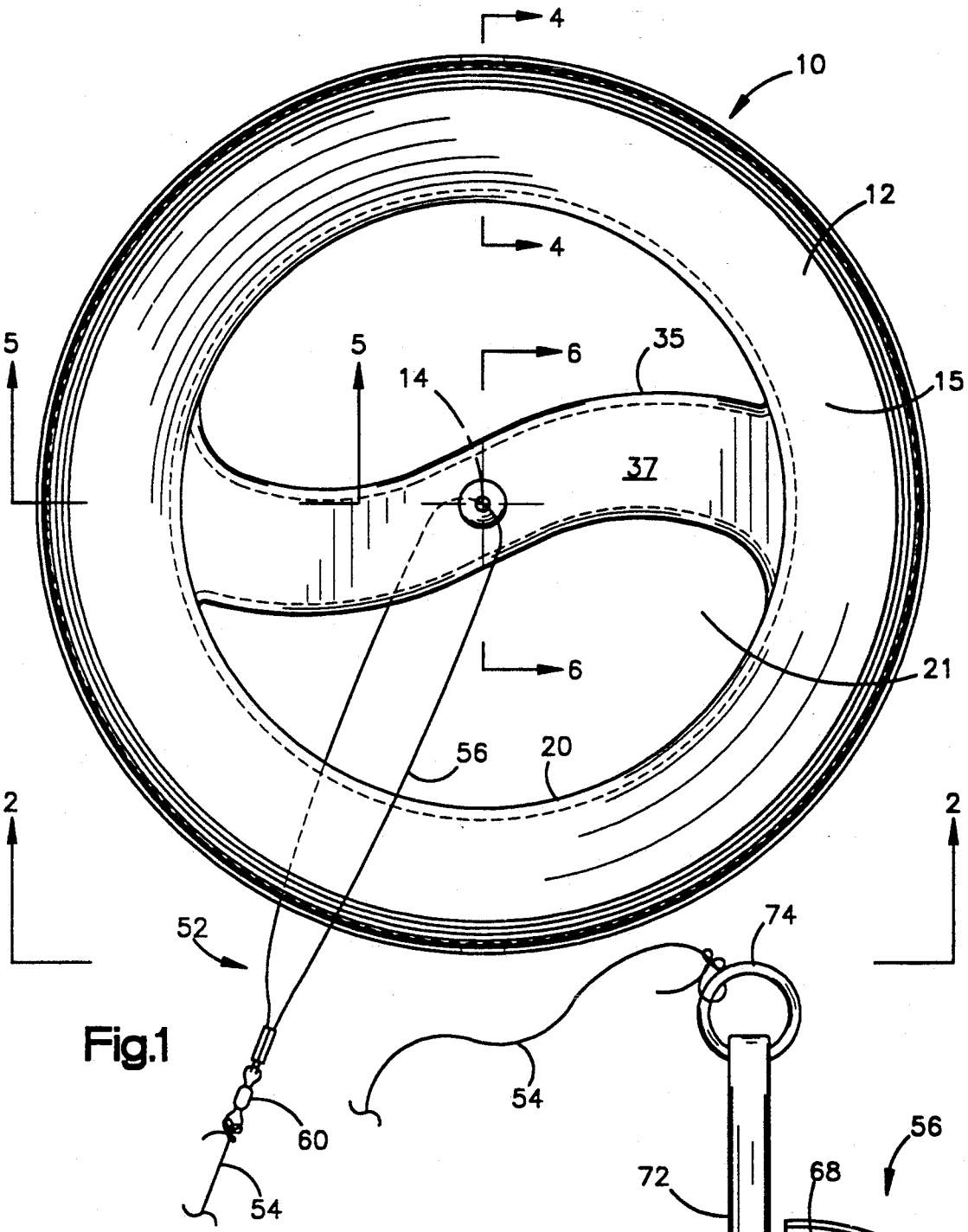
FIG. 1 is a top plan view of the ring-shaped flying toy constructed according to the principles of the present invention, with a partial illustration of the tether.

Referring to the drawings, and initially to FIGS. 1–4, a ring-shaped flying toy, illustrated generally at 10, includes an outer annular frame 12 formed from relatively rigid, lightweight material, e.g., polypropylene. The frame of the toy can be formed e.g., molded, in one piece using techniques known to those skilled in the art. The frame 12 is rotatable during flight about a central axis 14 which extends substantially perpendicular to the plane of the toy.

The frame 12 of the toy includes an upper substantially planar surface 15 and a lower substantially planar surface 16. The frame 12 extends upwardly and outwardly from the plane of the toy at an angle of approximately 13°. The frame then bends downwardly to form a circumferentially extending skirt 17. The lower surface 16 of the frame 12 preferably has a smooth, uninterrupted surface with a convex curvature which creates an air foil across the frame to cause horizontal and translatory motion when the toy is thrown. The thickness of the outer frame 12 is substantially uniform across the width of the frame, however, the frame can have a slightly greater thickness in the area of the skirt 17 to provide greater stability of the toy during flight and consequently greater distance. Additionally, a series of circumferentially extending grooves or ribs 19 can be formed on the outer surface toward the outer periphery of the frame to reduce aerodynamic drag during flight.

The frame of the toy further includes an inner edge 20 extending around the circumference of the toy to define a central opening 21, and an outer edge 22 which defines an outer border for the toy. The inner edge 20 and the outer edge 22 can have strengthening ribs or beads 25 extending circumferentially therearound to provide rigidity for the otherwise thin frame and to stabilize the toy in flight. The inner edge 20 preferably has a rounded configuration in profile, while the outer edge 22 can have a substantially flat configuration in profile to allow the thrower to comfortably and easily grasp the ring-shaped toy for throwing.

Figure 4:
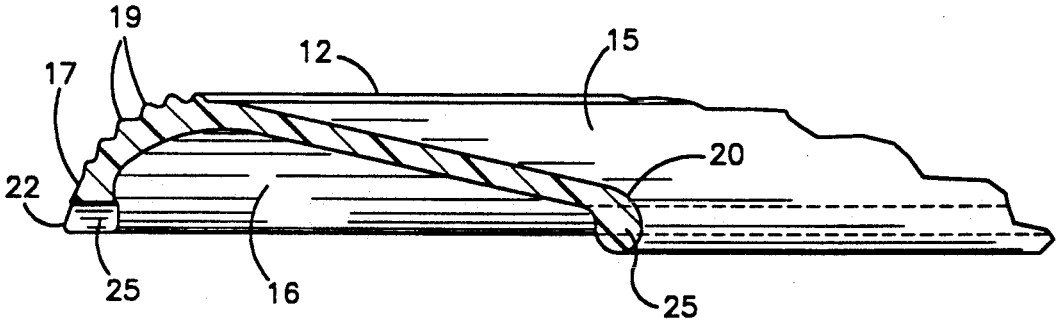
FIG. 4 is a cross-sectional side view of the outer frame of the ring-shaped flying toy taken substantially along the plane described by the lines 4—4 of FIG. 1.

Moreover, it is preferred that the outer edge 22 extend in a plane that is slightly upwardly offset from the plane of the inner edge 20, as illustrated most clearly in FIG. 4. Preferably for a ring-shaped toy with a frame having a 6.500 inch inner diameter, a 9.660 inch outer diameter, and a 0.439 inch height, the upward offset is approximately 0.045 inches. It has been determined that the particular convex curvature of the frame and the slight offset of the edges provides increased lift during rotation of the toy in flight, as compared to a frame where the inner and outer edges are co-planar, or where the edges have a greater offset.

Figure 5:
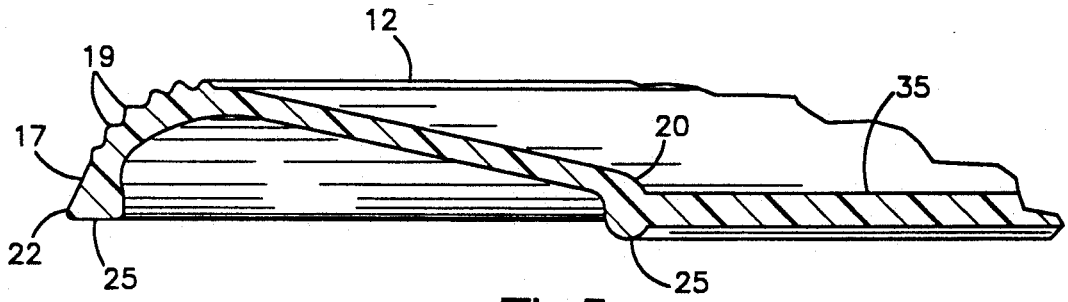
FIG. 5 is a cross-sectional side view of the outer frame for the ring-shaped flying toy taken substantially along the plane described by the lines 5—5 of FIG. 1.

A cross member 35 for the toy preferably comprises a thin, flat strip which is molded in one piece with the frame 12 and interconnects diametrically opposed portions of the frame. In particular, the cross member extends in the same plane as and interconnects the inner edge 20 on diametrically opposed portions of the outer frame (see e.g., FIG. 5). The cross member 35 has an upper surface 37 and a lower surface 38, and can include a pair of strengthening ribs or beads 40 extending along opposite edges to provide rigidity. The cross member 35 is preferably formed in an "S" shaped design, and is believed to provide stability and lift for the toy. For this reason, it has been determined to be important to maintain the cross member in a generally flat and level relation across the opening 21 of the toy. It has been determined that if the cross member becomes bowed or bent, the lift and stability of the toy can be adversely affected as the airflow across the toy is interrupted.

The cross member 35 includes an aperture 42 formed at the central axis 13 of the toy. More particularly, as illustrated in more detail in FIG. 6, the aperture 42 includes a collar 48 formed in one piece with and extending downwardly from the bottom surface 38 of the cross member 35. A sleeve 50 is inserted within the collar and secured therein using conventional techniques. The sleeve 50 is preferably formed from rigid material e.g., metal, and can be a grommet or a rivet.

A tether, indicated generally at 52, extends through the hollow middle of the sleeve 50 and allows the toy 10 to be thrown through the air and returned to the thrower. The tether 52 is preferably formed from lightweight string e.g., monofilament or nylon line. The strength and length of the tether can vary according to the weight and dimension of the ring, as well as the desired distance of flight. However, as an example, for a ring-shaped toy described previously with a weight of approximately 57 grams, it has been determined that a monofilament line of about 14 feet can be successfully used with the toy.

Figure 6:
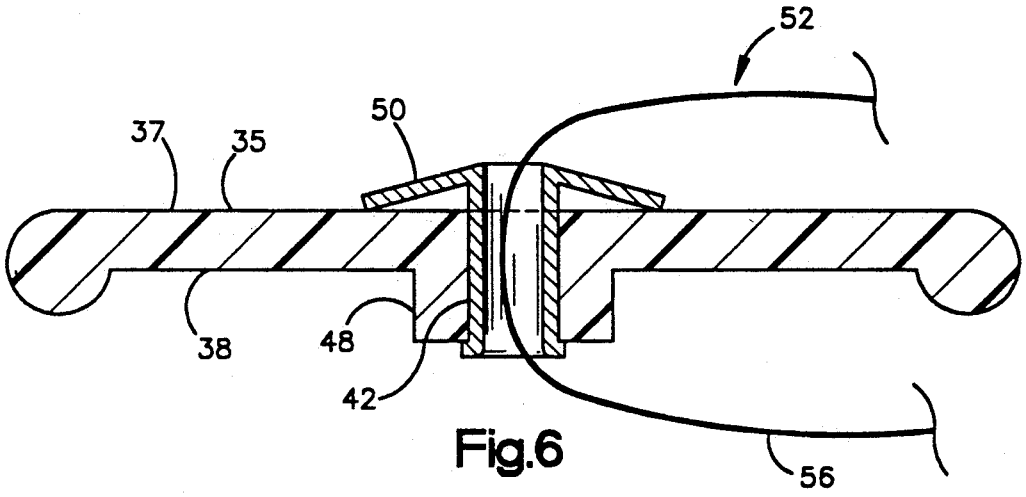
FIG. 6 is a cross-sectional side view of the cross member for the ring-shaped flying toy taken substantially along the plane described by the lines 6—6 of FIG. 1.

As illustrated in FIGS. 1 and 6, the tether 52 has a main portion 54 and a loop 56 which interconnects the main portion 54 with the toy 10. The loop 5 extends through middle of the sleeve 50 and is connected to one end of a swivel 60. The sleeve 50 allows substantially unimpeded and unrestricted movement of the tether loop 56 through the sleeve 50, and prevents rubbing or chafing of the tether. The sleeve 50 also extends a short distance above the upper surface 37 of the cross member (while the collar 48 extends below the lower surface 38) to reduce the rubbing of the tether loop on the outer frame 12 during flight.

Figure 1A:
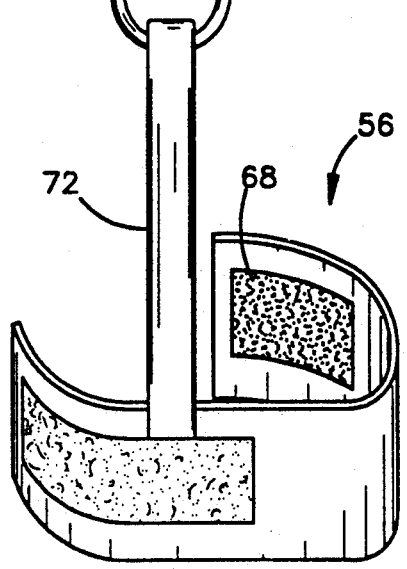
FIG. 1A is a perspective view of the wrist strap for the ring-shaped flying toy of FIG. 1, with another partial illustration of the tether.
Figure 2:
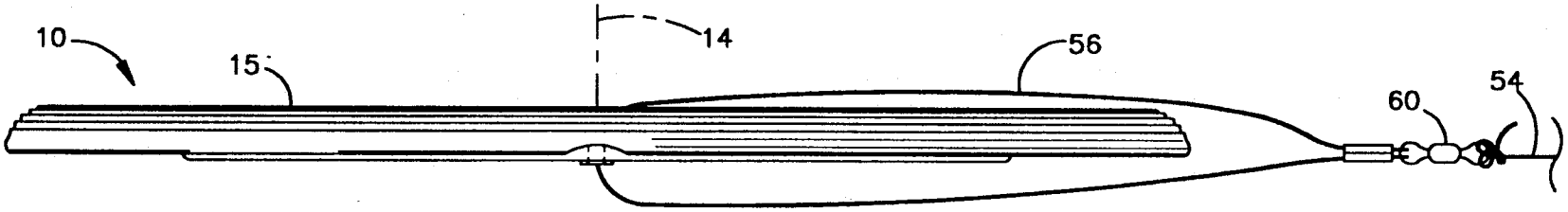
FIG. 2 is a side view of the ring-shaped flying toy taken substantially along the plane described by the lines 2—2 of FIG. 1.
Figure 3:
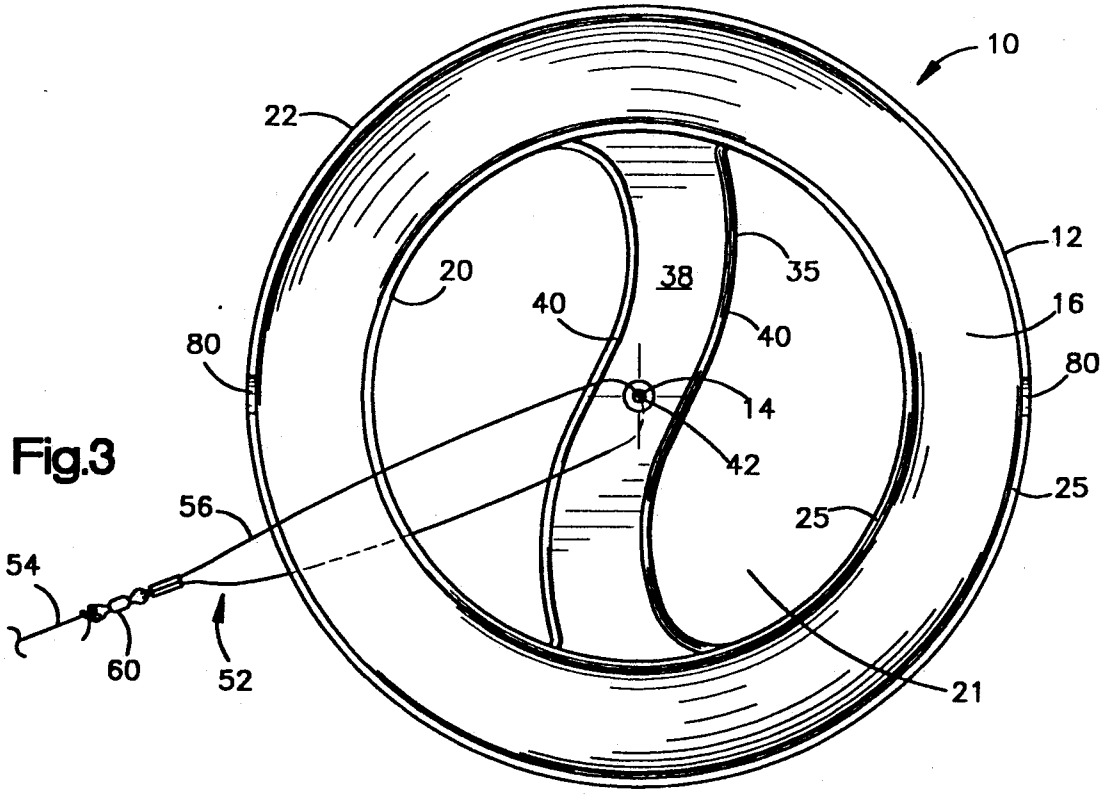
FIG. 3 is a bottom view of the ring-shaped flying toy of FIG. 1.

The main portion 54 of the tether is connected (e.g., tied) to the other end of the swivel 60. The free end of the main portion 54 is connected to a wrist strap, indicated generally at 66 in FIG. 1A. The wrist strap 66 can be formed from nylon or fabric material, and includes a fastening device 68, e.g., hook and loop fasteners, on opposite ends of the strap which enables the wrist strap to be attached around the arm of the thrower.

An elastic band portion 72 interconnects the wrist strap 56 with the main portion 54 of the tether line 52. The elastic band portion 72 can be formed in a number of ways to provide a short, elastic segment, such as for example, by providing an inner elastic strip with an outer elastic covering. Preferably, for the flying toy described above, the elastic band portion 72 is approximately 6 inches long to impart a controlled elasticity to the tether line. The elastic band portion 72 can be attached on one end to the wrist strap 56 by e.g., sewing and/or adhesive, and on the other end to a plastic or rubber ring 74 by e.g., folding a length of the band portion 72 around the ring 74 and sewing the overlapping sections together. The main tether 54 can then be attached (e.g., tied) to the ring 75. The ring 74 and swivel 60 allow the tether line to be quickly and easily replaced if broken by untying the broken tether line and tying on new line to the ring and swivel.

The elastic band portion 72 is believed to increase the proficiency of the thrower in learning how to throw the ring-shaped flying toy. More particularly, after the toy is thrown through the air and reaches the end of the tether, the thrower imparts a slight tug on the tether to cause the toy to return in the thrower's direction. The elastic band portion provides some flexibility in timing the "tug", as well as in preventing the relatively inelastic tether line from "snapping" and possibly breaking when the toy reaches the full length of the tether. Nevertheless, the short length of the elastic band portion and the location of the elastic band portion proximate the arm is not believed to substantially increase the overall weight of the flying toy so as to alter the distance or stability of the flight.

Typically during a normal throwing motion, the thrower grasps the outer frame 12, positions an index finger along the inner surface of the skirt 17, and positions the thumb along the outer surface of the frame. The flight of the flying disk-type toy is generally in the manner of a standard flying saucer or flying disk-type toy where the toy is spun about its axis and launched in a generally horizontal direction. The convex curvature of the frame requires air passing over the frame to travel a greater distance than the air passing under the frame to thereby create a low pressure zone under the frame, and consequently, lift for the toy.

As the toy reaches the end of the tether line, the tether is pulled taught, which stretches the elastic band portion 42 until the continued forward motion of the toy is prevented. Using a slight backward pull by the thrower, the toy returns to the thrower, and, if sufficient spin is provided, will make repeated passes past the thrower, so long as the toy maintains a spinning motion. A more detailed description of the motion of flight of a tethered toy, as well as exemplary uses for such a toy, is provided in Liotta, U.S. Pat. No. 3,673,732, and Seymour, U.S. Pat. No. 3,976,297.

Figure 7:
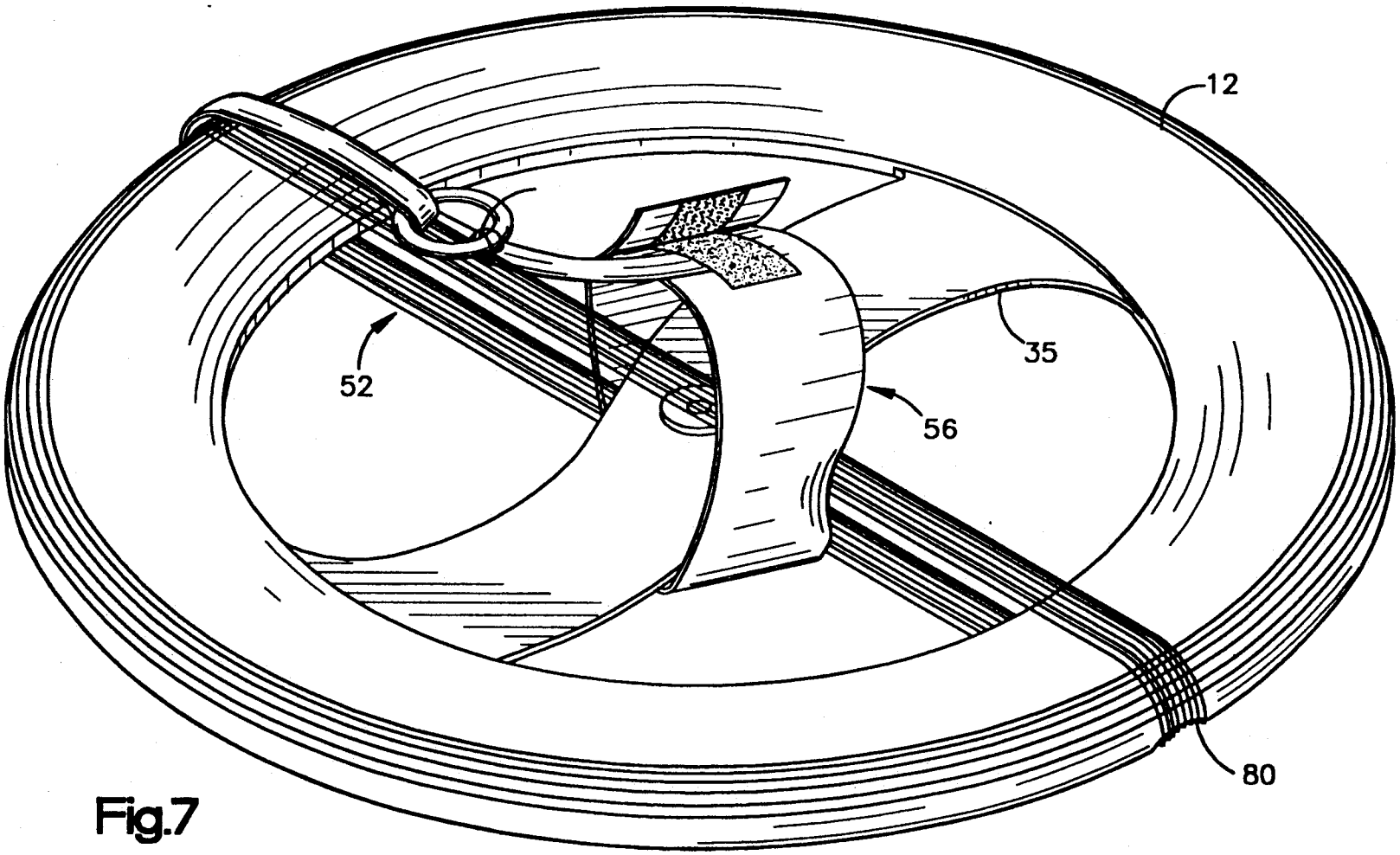
FIG. 7 is a perspective view of the ring-shaped flying toy illustrating the tether wrapped in a coil around the toy during storage.

When the toy is not being thrown, the tether line 52 can be wrapped around the outer frame 12 for storage, for example as illustrated in FIG. 7. More particularly, the tether is preferably wrapped in a coil transversely around the frame 12 substantially perpendicular to (i.e., 90° offset from) the S-shaped cross member 35. In this manner, warpage or bending of the toy, and in particular the cross member 35, is prevented because the compression of the coiled tether on the frame substantially balances the tension provided by the cross member. The toy will thereby remain in a relatively planar orientation even when subject to heat or direct sunlight. As indicated previously, the toy has better aerodynamic qualities when the cross member is flat and level, rather than being warped or bent because of improper storage.

To facilitate wrapping the tether 52 around the toy, a pair of notches 80 (FIG. 3) can be formed in the outer edge 22 on diametrically opposed portions of the frame, substantially perpendicular to (i.e., 90° offset from) the cross member 35. The notches can have a generally tapered design to prevent the tether loop 56 from catching thereon (or rubbing and chaffing) during rotation of the toy. However, the notches 80 provide a simple and convenient method of winding the tether line properly about the flying toy during storage which prevents tangling and knotting. Additionally, to prevent the tether from unwinding during storage, the wrist strap 56 can be located and secured around both the cross member 35 and the tether line 52.

Accordingly, as described above, the present invention provides an improved flying toy, and in particular, an improved tethered, ring-shaped flying toy. The flying toy has a configuration which has aerodynamic qualities for long flights, allows the thrower to become proficient with the flying toy in a brief period of time, and can be properly stored in such a manner to prevent warpage or bending of the toy when not in use.

With the foregoing disclosure in mind, it is believed that various other modifications of the structures disclosed above will become apparent to those of ordinary skill in the art.

We claim:

1. A flying toy, comprising:

a ring-shaped frame rotatable about an axis substantially perpendicular to a plane of the toy, said frame extending upwardly and outwardly from the plane away from the axis and having a downwardly extending skirt around the periphery thereof, said frame including an inner circumferential edge defining an opening through the frame and said skirt including an outer peripheral edge defining a border, the outer peripheral edge of said skirt lying in a plane which extends in parallel but upwardly offset relation from the plane of the inner circumferential edge to increase lift during the flight of the toy, said frame also including an upper surface and a lower surface, said lower surface being smooth and continuous and providing a convex curvature which creates an air foil for the toy during flight.

2. A flying toy as in claim 1, wherein said frame extends at approximately a 13 degree angle away from the plane of the toy.

3. A flying toy as in claim 1, further including a cross member extending transversely across and interconnecting two locations on the inner circumferential edge of the frame.

4. A flying toy as in claim 3, wherein said cross member includes a connection for a tether, said tether allowing the flying toy to return in the direction of the thrower during flight.

5. A flying toy as in claim 1, wherein said frame includes strengthening ribs extending circumferentially around the inner and outer circumferential edges to provide rigidity and stability during the flight.

6. A flying toy as in claim 5, wherein said frame includes circumferentially extending grooves on the outer surface thereof proximate to the periphery of the frame to reduce aerodynamic drag during flight.

7. A flying toy, comprising:

a ring-like frame rotatable about an axis substantially perpendicular to a plane of the toy, said frame extending upwardly and outwardly from the plane away from the axis and having a downwardly extending skirt around the periphery thereof, said frame including an inner circumferential edge defining an opening through the frame and said skirt including an outer peripheral edge defining a border, the outer peripheral edge of said skirt lying in a plane which extends in parallel but upwardly offset relation from the plane of the inner circumferential edge to increase lift during the flight of the toy, said frame also including i) an upper surface and a lower surface, said lower surface being smooth and continuous and providing a convex curvature which creates an air foil for the toy during flight, ii) strengthening ribs extending circumferentially around the inner and outer circumferential edges to provide rigidity and stability during the flight, and iii) further including a cross member extending transversely across and interconnecting diametrically opposed portions of the inner circumferential edge of the frame.

8. A flying toy as in claim 7, wherein said cross member includes a connection for a tether, said tether allowing the flying toy to return in the direction of the thrower during flight.

9. A flying toy, comprising:

a tether, and a ring-like member rotatable about an axis generally perpendicular to a plane of the toy, said ring-like member including:

a) a connection for the tether, b) a frame having a pair of notches formed on diametrically opposed portions around the outer periphery thereof, and c) a cross member extending transversely across and interconnecting diametrically opposed portions of said frame generally perpendicularly offset from said pair of notches, said notches enabling the tether to be wrapped in a coil transversely around said frame in a direction substantially perpendicular to said cross member.

10. A flying toy as in claim 9, wherein said cross member extends in a substantially flat and level relation across the frame.

11. A flying toy as in claim 10, wherein said connection includes an aperture for the tether, the tether extending through the aperture in a loop around the frame of the ring-like member, each of said notches have a tapered shape to prevent the loop from catching on the edges of the notches during rotation of said ring-like member.

12. A tethered flying toy, comprising:

a ring-like member, a wrist connection device, a tether connected to said ring-like member and extending from said ring-like member to said wrist connection device, said wrist connection device including a strap to connect the tether to an arm of a person, and an elastic band portion interconnecting said strap and said tether to provide elasticity for said tether during the flight of the toy.

13. A tethered flying toy as in claim 12, wherein said wrist connection device also includes a ring interconnecting one end of said elastic band portion and said tether.

14. A tethered flying toy as in claim 13 wherein said strap is designed to encircle the arm of the person and be secured therearound.

15. A tethered flying toy as in claim 14 wherein the length of said strap is relatively short as compared to the length of said tether.

16. A flying toy, comprising:

a ring-like frame rotatable about an axis substantially perpendicular to a plane of the toy, said frame extending upwardly and outwardly from the plane away from the axis and having a downwardly extending skirt around the periphery thereof, said frame including an inner circumferential edge defining an opening and said skirt including an outer circumferential edge defining a border, the outer circumferential edge of said skirt lying in a plane which extends in parallel but upwardly offset relation from the plane of the inner circumferential edge to increase lift during the flight of the toy, a wrist connection device having a strap designed to be connected around the arm of a person, a tether connected to said ring-like frame and extending from said ring-like frame to said wrist connection device, and an elastic band portion interconnecting said strap and said tether to provide elasticity for said tether during the flight of the toy, said frame also having a pair of notches formed on diametrically opposed portions of the frame, and a cross member extending transversely across and interconnecting diametrically opposed portions of said frame generally perpendicularly offset from said pair of notches, said notches enabling the tether to be wrapped in a coil transversely around said frame in a direction substantially perpendicular to said cross member.

17. A tethered flying toy, comprising:

a ring-like member, a wrist connection device, a tether connected to said ring-like member and extending from said ring-like member to said wrist connection device, said wrist connection device including an elastic band portion interconnecting said wrist connection device and said tether to provide elasticity for said tether during the flight of the toy.

* * * * *